US006719158B2

(12) United States Patent
Goldberg

(10) Patent No.: US 6,719,158 B2
(45) Date of Patent: Apr. 13, 2004

(54) CLOTHES SUPPORT ASSEMBLY

(76) Inventor: Leonard M. Goldberg, 493 Baywillow Dr., Ballwin, MO (US) 63011-3420

( * ) Notice: Subject to any disclaimer, the term of this patent is extended or adjusted under 35 U.S.C. 154(b) by 0 days.

(21) Appl. No.: 09/978,237

(22) Filed: Oct. 16, 2001

(65) Prior Publication Data

US 2003/0071001 A1 Apr. 17, 2003

(51) Int. Cl.[7] ..... A47F 5/00
(52) U.S. Cl. ..... 211/123; 211/94.01; 211/105.1
(58) Field of Search ..... 211/105.1, 105.3, 211/94.01, 162, 123; 206/291, 298

(56) References Cited

U.S. PATENT DOCUMENTS 2,757,804 A * 8/1956 Sadwin ..... 211/94.01
2,771,196 A * 11/1956 Scheuermann ..... 211/94.01
2,975,949 A * 3/1961 Lutsky
3,023,450 A * 3/1962 Renner et al.
3,051,318 A * 8/1962 Murphy ..... 211/94.01
3,313,424 A * 4/1967 Gingher
3,339,749 A * 9/1967 Odegaard et al. ..... 211/94.01
3,563,182 A * 2/1971 MacFarlane
3,610,427 A * 10/1971 Maziarka ..... 211/123
3,891,091 A * 6/1975 Anderson ..... 211/105.3

* cited by examiner

*Primary Examiner*—Robert W. Gibson, Jr.
(74) *Attorney, Agent, or Firm*—Henry W. Cummings

(57) ABSTRACT

In accordance with the present invention a formed channel includes a body portion having laterally spaced side walls, and a bottom portion having laterally spaced tracks for supporting truck wheels each including vertical walls for guiding the truck wheels. Means are provided to maintain depending clothing hooks spaced from the wheels and perpendicular to the axles. This may comprise a single piece clothing hook shank or an additional separate spacer. A groove is provided between the vertical walls for guiding the truck wheels. A slot is provided between the vertical walls for the hooks depending from the truck to pass through, for supporting clothes hangers.

11 Claims, 8 Drawing Sheets

CLOTHES SUPPORT ASSEMBLY

FIELD OF THE INVENTION

This invention relates to apparatus for supporting clothes in closets or on racks such as are commonly used in clothing stores or in homes and apartments.

BACKGROUND OF THE INVENTION

U.S. Pat. No. 356,125 discloses a clothes rack for wardrobes which employs a plurality of garment hooks or clothes hangars attached to a slidable unit which can be drawn out of a closet or wardrobe directly toward the user. The garment hooks are fixed in relation to one another.

U.S. Pat. No. 512,519 in a similar manner to U.S. Pat. No. 356,125, also discloses a clothes rack for wardrobes which employs a plurality of hooks or clothes hangars attached to a slidable unit which can be drawn our of a closet or wardrobe directly toward the user. The garment hooks are fixed in relation to one another.

U.S. Pat. No. 2,757,804 discloses an extendable closet rod employing a track having a center slot with a moveable wheeled hangar bracket, but does not disclose any structure for connecting the track to a supporting wall in a closet, wardrobe, or store rack.

U.S. Pat. No. 3,563,182 discloses a combined shelving and clothes bar apparatus that is adjustable in width, and employes various means of mounting said apparatus in a closet or on a wall. The apparatus also includes slidable hooks for clothes hangars, but they depend upon low friction material to provide freedom of movement instead of wheels.

Furthermore, none of these references specifically disclose means for maintaining depending hooks perpendicular to the transverse wheel axles and proper spacing between the wheels.

Also, none of these references specifically disclose a spacer engaging the depending hooks which assist in maintaining the depending hooks perpendicular to the transverse wheel axles and proper spacing between the wheels.

SUMMARY OF THE INVENTION

A. Objects of the Invention

One object of the present invention is to provide a clothes supporting assembly which may be used in both household clothes closets and display racks in retail stores.

Another object of the invention is to provide a clothes supporting assembly which can be supported by closet end walls or racks in retail sores.

Another object of the invention is to provide an inexpensive and practical cart hanger supporting assembly with axles and spaced wheels.

Another object is to provide an assembly which provides spacing means for maintaining the clothing hooks spaced from the wheels, perpendicular to the axles.

B. Summary

In accordance with the present invention a formed channel includes a body portion having laterally spaced side walls, and a bottom portion having laterally spaced tracks for supporting truck wheels each including vertical walls for guiding the truck wheels. Means are provided to maintain depending clothing hooks spaced from the wheels and perpendicular to the axles. This may comprise a single piece clothing hook shank or an additional separate spacer. A groove is provided between the vertical walls for guiding the truck wheels. A slot is provided between the vertical walls for the hooks depending from the truck to pass through, for supporting clothes hangers. The formed channel is supported in cooperating slots located at opposite end walls defining the closet or display area. The slots may be formed in the end walls or located in supports attached to the respective end walls.

THE DRAWINGS

FIG. 2B is a perspective view which shows a hook having an insert engaging the hook enlarged top portion and openings for the axles to paas through.

DESCRIPTION OF PREFERRED EMBODIMENTS

Figure 1:
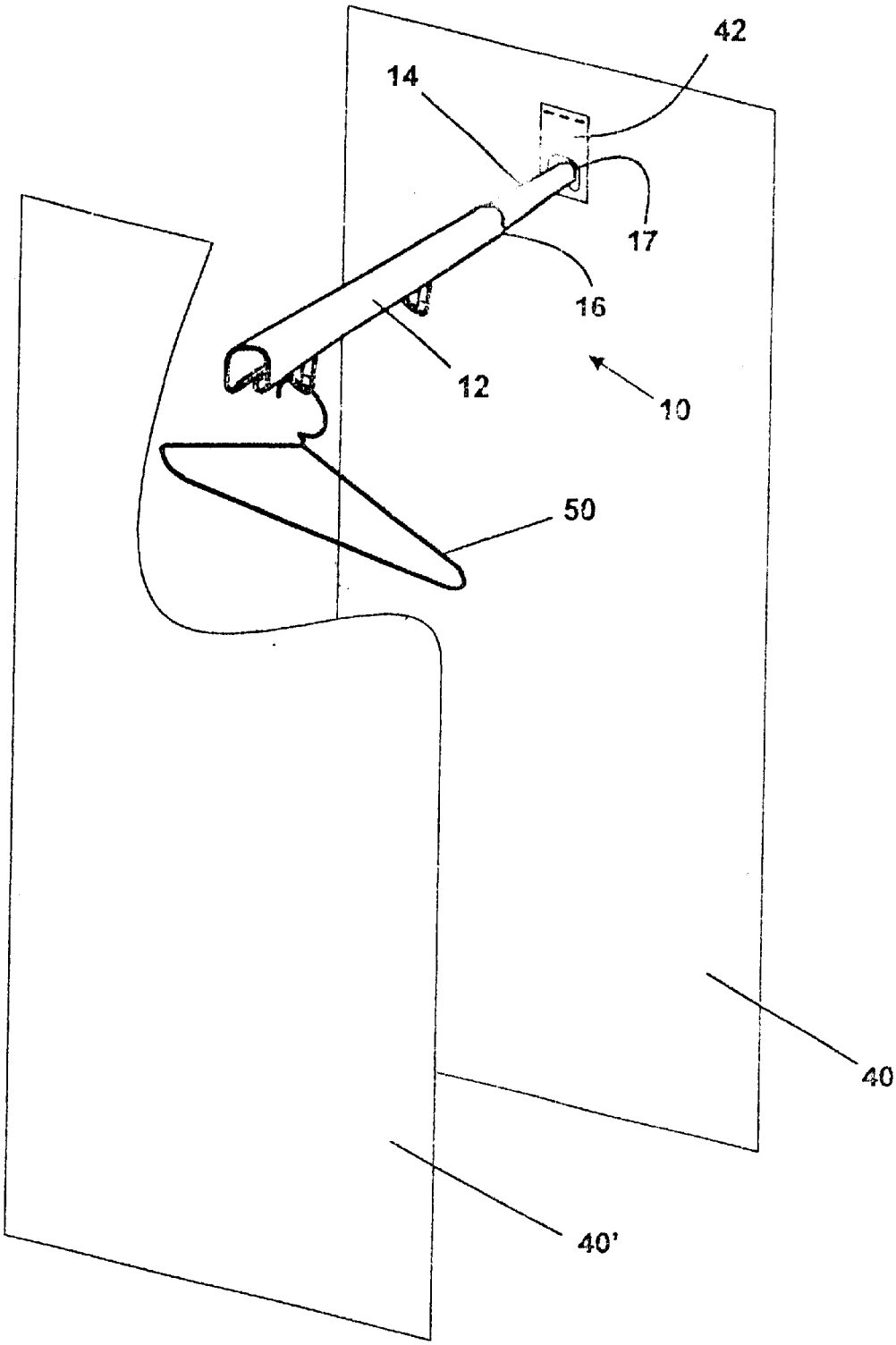
FIG. 1 is a perspective view showing the present invention installed in a typical closet or wardrobe, with a commercially available wire clothes hanger depending upon from one of the hooks.
Figure 1A:
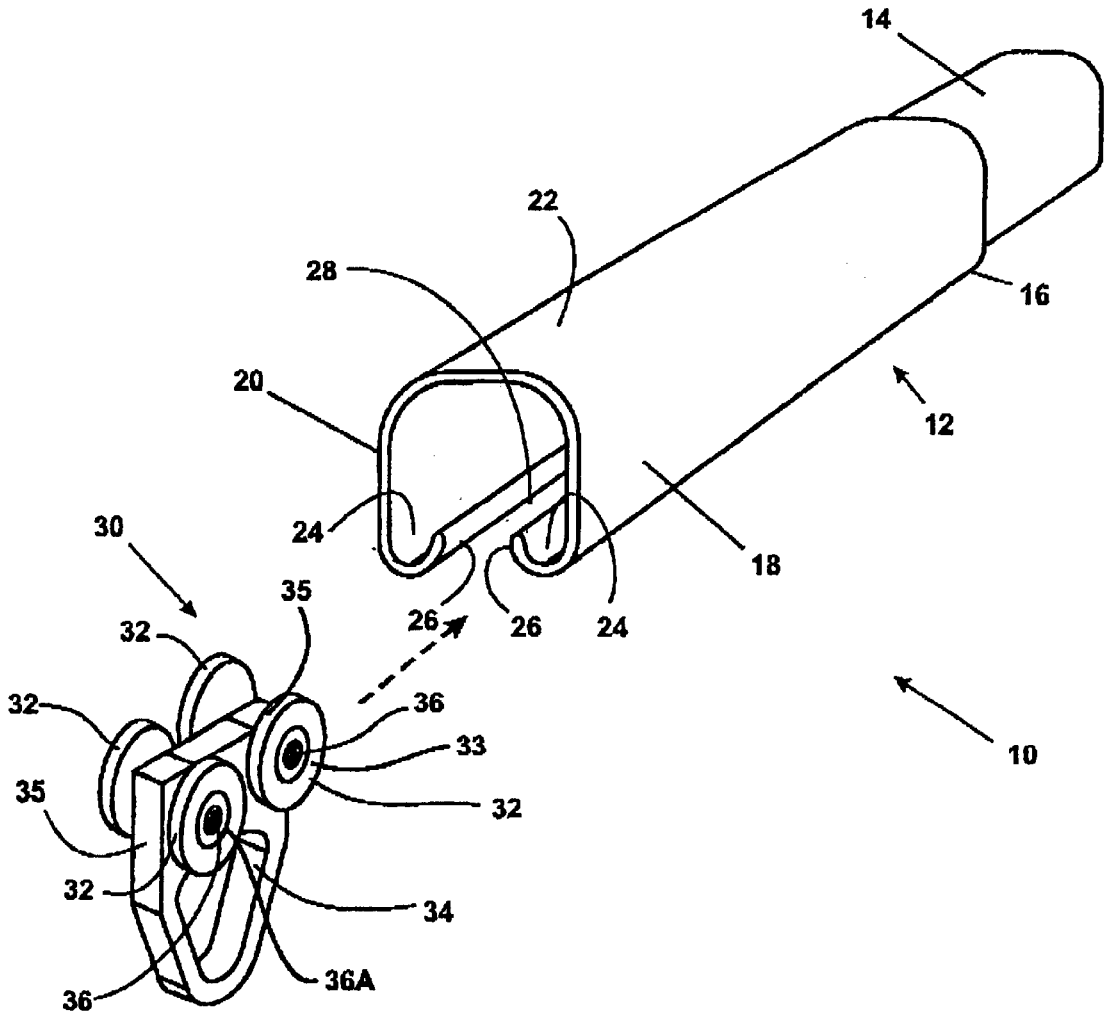
FIG. 1A is an exploded, perspective view of the present invention, showing the formed channels and one wheeled truck assembly.
Figure 2:
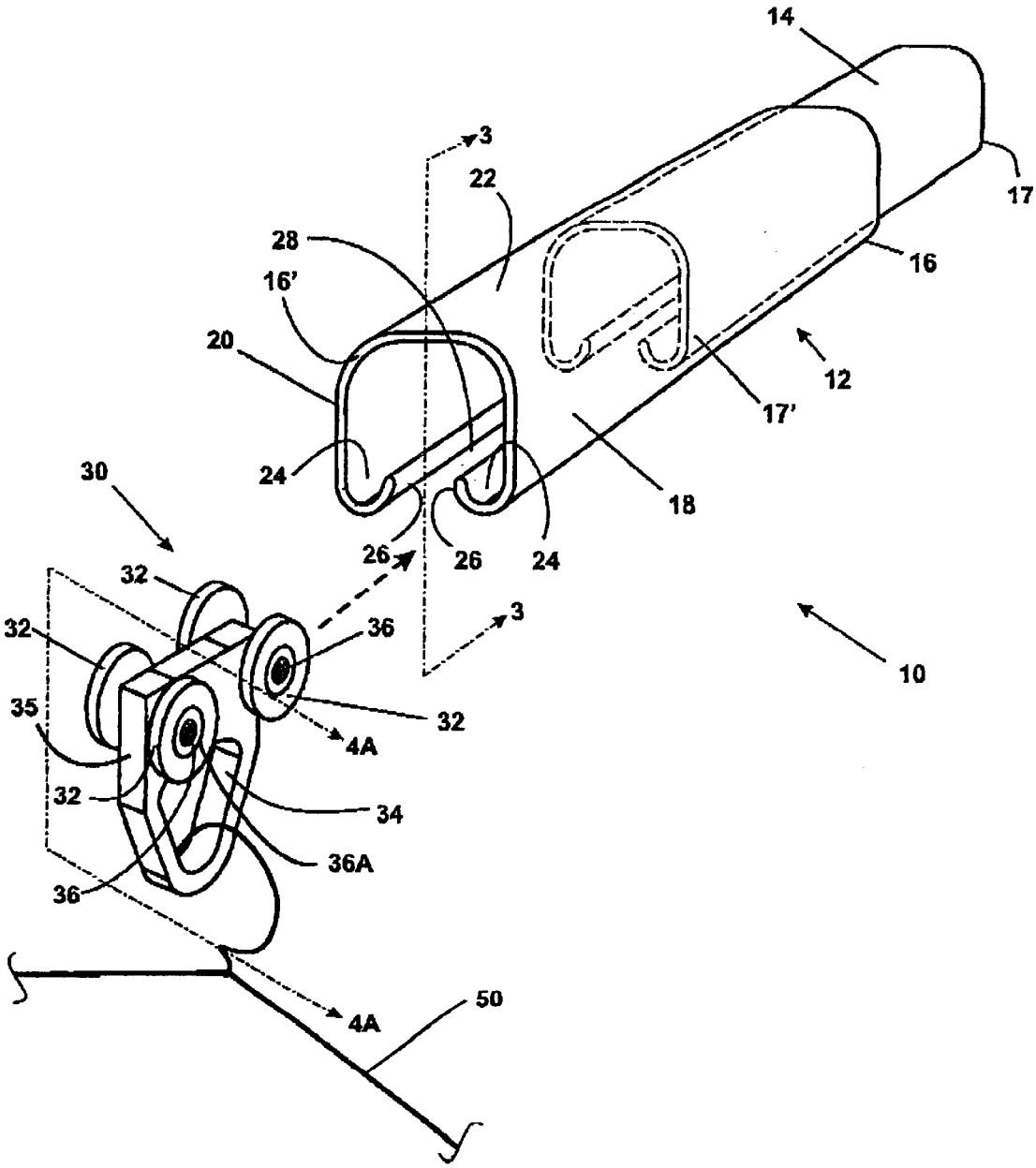
FIG. 2 is an exploded, perspective view of the present invention, showing the telescoping formed channels and one wheeled truck assembly.
Figure 2A:
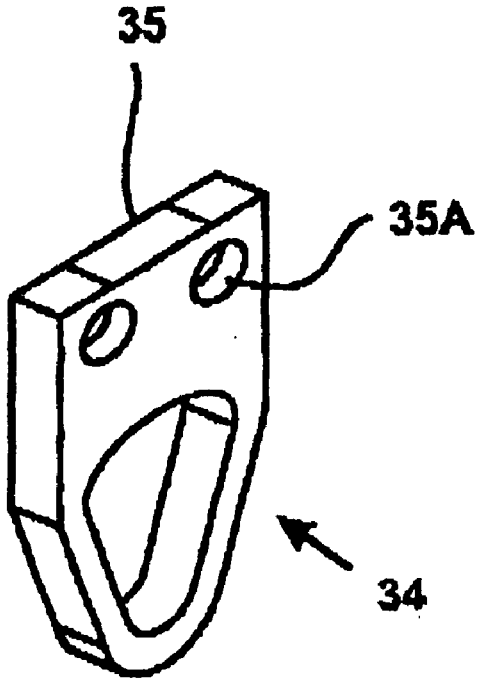
FIG. 2A is a detail view of a hook having an enlarged upper portion which includes opening for receiving the longitdinally spaced truck axles.
Figure 2B:
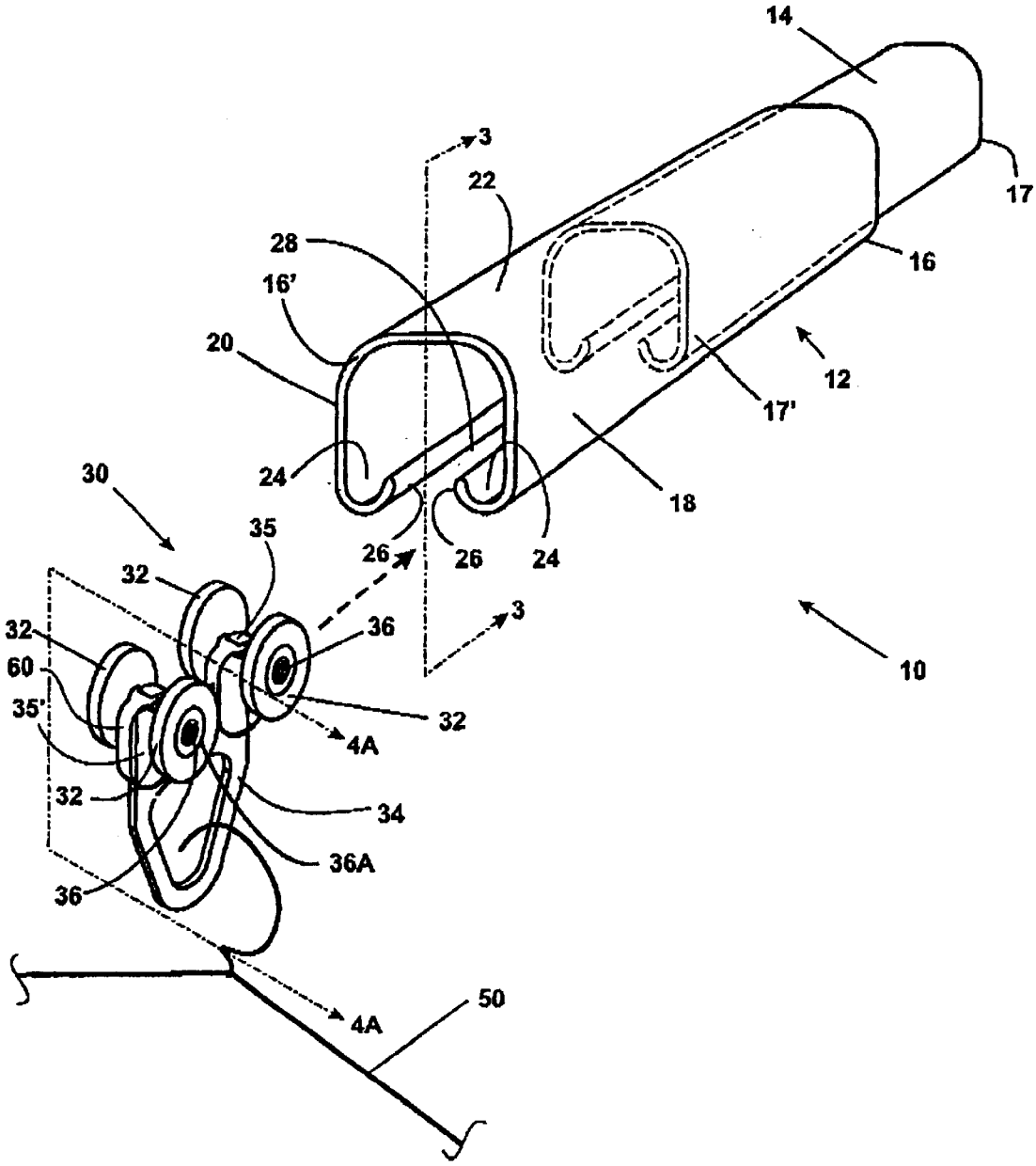
Figure 3:
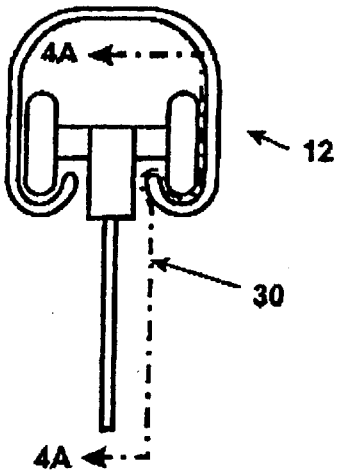
FIG. 3 is a front elevation view of the wheeled truck assembly shown in FIG. 2.
Figure 4A:
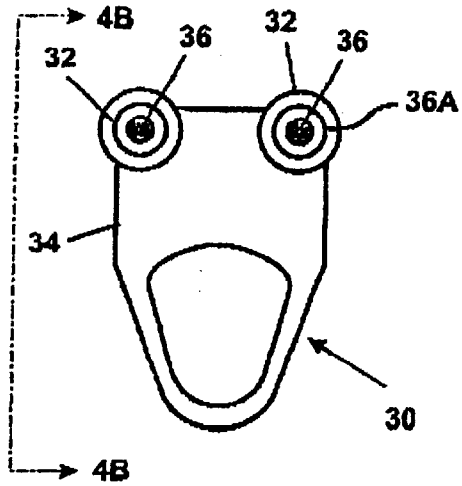
FIG. 4A is a detail view of the wheeled truck assembly looking in the direction of the arrows along the line 4A—4A in FIG. 3.
Figure 4B:
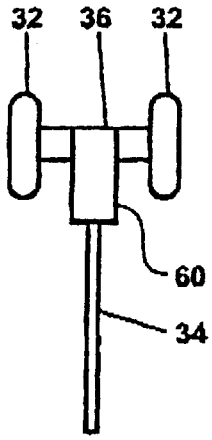
FIG. 4B is a detail view of the wheeled truck assembly looking in the direction of the arrows along the line 4B—4B in FIG. 4A.
Figure 3A:
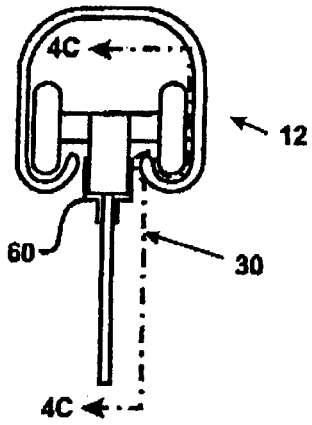
FIG. 3A is a front elevation view of the wheeled truck assembly shown in FIG. 2B.
Figure 4C:
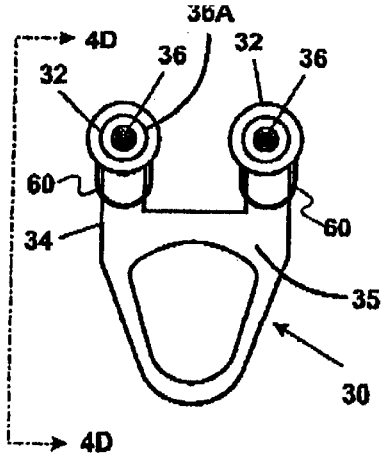
FIG. 4C is a detail view of the wheeled truck assembly looking in the direction of the arrows along the line 4C—4C in FIG. 3A.
Figure 4D:
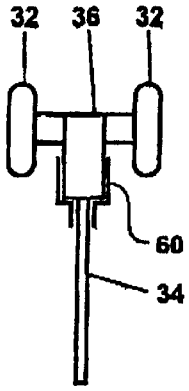
FIG. 4D is a detail view of the wheeled truck assembly looking in the direction of the arrows along the line 4D—4D in FIG. 4C.
Figure 5:
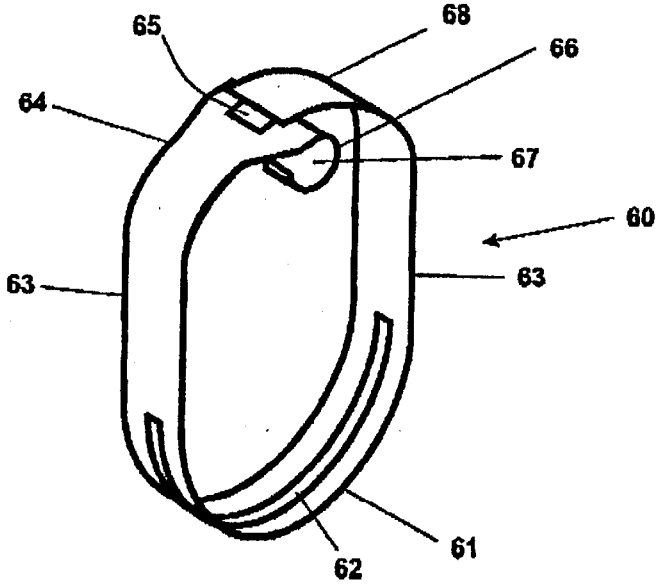
FIG. 5 is a perspective view of the spacer.

In accordance with the present invention, in one embodiment a clothes supporting assembly 10 comprises formed channels 12 and 14, wheeled truck assembly 30 FIG. 1A, and support 42. Formed channel 14 is sized to fit inside formed channel 12, where it can be adjusted in and out to fit the size of the enclosure. The assembly is supported in a typical closet or wardrobe having walls 40, 40' with a commercially available wire clothes hanger 50 depending from one of the hooks 34.

Formed channels 12 and 14 are made of metal, plastic, or other material suitable for supporting a plurality of garments, and allowing the wheeled truck assembly to move back and forth without imposing undue wear on the formed channels.

The sectional shape of formed channels 12 and 14 is arcuate, affording greater strength. Formed channels 12 and 14 comprise side walls 18 and 20, roof 22, laterally spaced tracks 24 including vertical walls 26. Side walls 18 and 20 support roof 22, which in turn separates the side walls, forming slot 28. Laterally spaced tracks 24 are formed between side walls 18 and 20, and vertical walls 26. Tracks 24 have an arcuate shape, affording greater strength. Slot 28 is wide enough to permit wheeled truck assembly 30 to move back and forth without binding.

Wheeled truck assembly 30 comprises wheels 32, bearings 33 slotted hooks 34 having a top body portion 35, having openings 35*a* which receives axles 36, and a bottom portion 37 to receive clothes hangers 50. The components of the wheeled truck assembly can be made of metal, plastic, or other durable material capable of supporting the weight of various garments, and capable of withstanding movement over a long period of time. Slotted hooks 34 are formed to be rugged including enlarged top body portion 35 to maintain the hooks 34 perpendicular to the axles 36 and properly spaced between wheels 32. After wheels 32 are installed, the ends of axle 36 are flared at 36*a* to prevent wheels 32 from coming off the ends.

In another embodiment as shown in FIGS. 2B, 3A, 4A, 4C, 4D and 5, a spacer 60 comprises body portion 63, lower curved portion 61, flared upper portion 64, and straight upper portion 68. Flared upper portion 64 is forked, forming upper axle slot 65. Loops 66 are formed at the forked ends of flared upper portion 64, producing axle housing 67. Slot 62 is located in the center of lower curved portion 61, which receives hook portion 35'.

Slotted spacer 60 is mounted over hook portion 35', which protrudes through slot 62 and upper slot 66. Axle 36 is inserted through axle housing 67 and a corresponding opening 35*a* in hook 34.

After wheels 32 are installed, the ends of axle 36 are flared at 35*a* to prevent wheels 32 from coming off the ends. Slotted spacers 60 are prevented from coming off hook 34 due to axles 36 being routed through the holes 35 in hook 34. Spacers 60 hold hooks 34 perpendicular to axles 36 and maintain the correct spacing between wheels 32 so they will stay in track 24.

Hook 34 can be any convenient shape providing a mounting surface for axles 36, and an opening to accept clothes hanger 50. Wheels 32 are round in shape with rounded surfaces to bear on tracks 24. They are sized so as to roll freely inside the formed channels.

Figure 6:
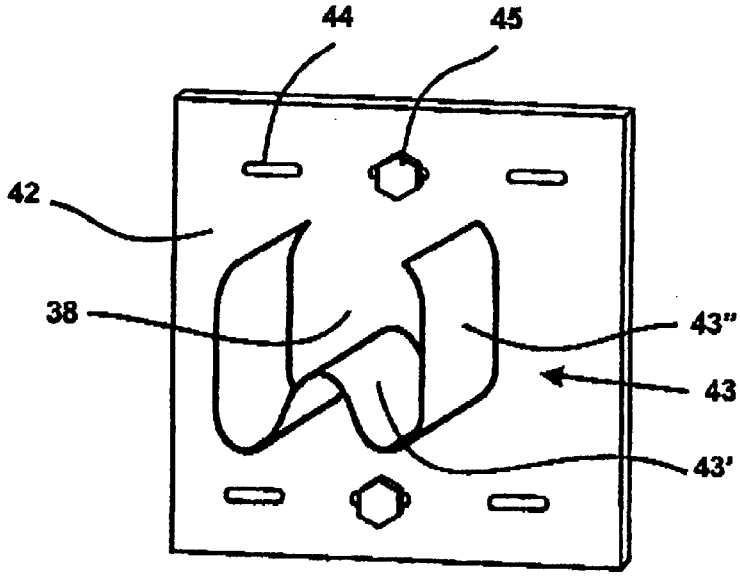
FIG. 6 is a perspective view which shows a mounting assembly for an end wall of one embodiment of the invention.

Support 42 shown in FIG. 6 is made of metal, plastic, or other material capable of supporting the weight of the loaded apparatus. Support 42 is mounted on the end walls of a closet, wardrobe, or other enclosure by means of mounting holes 44, and fasteners 45. Walls 43' and 43" are connected to support 32 to define a cooperating slot 38 for purposes of accepting the ends 16 of the formed channels.

Figure 7:
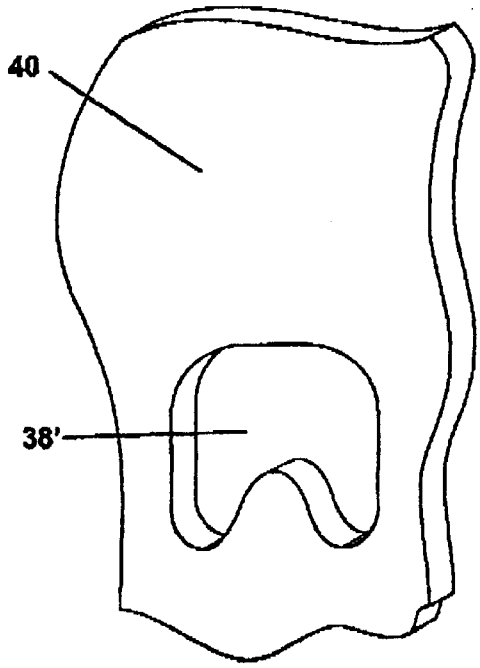
FIG. 7 is a perspective view which shows a detail of a cutout in an end wall of another embodiment of the invention.

In another embodiment shown in FIG. 7, wall 40 includes a slot 38' for purposes of accepting the ends 16 of the formed channels.

What is claimed is:

1. A clothes support assembly consisting of:

a formed channel; and at least one wheeled truck assembly riding in said formed channel; and separate support means for attaching said formed channel to the wall of a closet or other enclosure comprising at least one cooperating slot in the wall to retain said formed channel.

2. A clothes support assembly consisting of:

a formed channel; and at least one wheeled truck assembly riding in said formed channel; and separate support means for attaching said formed channel to the wall of a closet or other enclosure, wherein said means for attaching said formed channel to the wall comprises separate wall means defining said cooperating slot to retain said formed channel, and wherein said means for attaching said formed channel to the wall comprises wall means including laterally spaced outer wall means and interior wall means located within said outer wall means for supporting the ends of said formed channel.

3. A clothes support assembly comprising:

at least two formed channels wherein one channel is dimensionally smaller than the other channel, allowing said channels to slide adjustably with respect to one another;

at least one wheeled truck assembly riding in said formed channels;

a separate support means for attaching said formed channels to the wall of a closet or other enclosure; and wherein said formed channels contain outer walls, a roof, vertical walls, and laterally spaced tracks; and said laterally spaced tracks provide a surface to support wheeled truck assemblies; and spacing means maintaining proper spacing between the wheels;

said spacing means comprising two slotted spacers, said spacers maintaining proper spacing between said wheels.

4. A wheeled truck assembly for a clothes support assembly comprising:

at least two wheels;

at least two axles;

at least one hook which provides support for clothes hangers; and spacing means for maintaining said hook perpendicular to said axles and spaced from said wheels comprising;

two slotted spacers, each spacer comprising an enlarged top body portion having an opening for receiving one of said axles;

each said spacer further comprising means for engaging said hook comprising at least one slot.

5. A clothes supporting assembly consisting essentially of:

a formed channel including;

a body portion having laterally spaced side walls, a bottom portion having laterally spaced tracks for supporting a truck having truck wheels mounted on axles, each track including a vertical wall for guiding said truck wheels, and a slot located between said vertical walls;

a hook depending from the truck passing through said slot for supporting clothes hangers, and cooperating end slots located at opposite respective end walls defining a closet or display area for supporting said formed channel, wherein said end slots are located in a location selected from said respective end walls and in supports attached to said respective end walls including laterally spaced outer walls and interior walls located there between.

6. A clothes supporting assembly according to claim 5 including spacing means including two slotted spacers for maintaining said hook perpendicular to said axles and spaced from said wheels.

7. A spacer consisting essentially of:

a body portion including at least two laterally spaced arms;

an upper portion extending between said arms;

said upper portion having means for engaging at least one truck axle;

and a lower portion having means for engaging at least one clothes hook;

said upper portion being forked, forming at least one upper slot for engaging said axle.

8. A spacer according to claim 7 wherein said upper portion includes loops having forked ends for engaging said axle.

9. A spacer according to claim 7 wherein said lower portion includes a slot for engaging said clothes hook.

10. A spacer according to claim 9 wherein said slot is located generally in the center of said lower portion.

11. A spacer according to claim 10 wherein said hook protrudes through said slot.

* * * * *